United States Patent [19]

Broadhurst

[11] Patent Number: 4,879,518

[45] Date of Patent: Nov. 7, 1989

[54] LINEAR PARTICLE ACCELERATOR WITH SEAL STRUCTURE BETWEEN ELECTRODES AND INSULATORS

[75] Inventor: John H. Broadhurst, Golden Valley, Minn.

[73] Assignee: Sysmed, Inc., Eden Prairie, Minn.

[21] Appl. No.: 107,093

[22] Filed: Oct. 13, 1987

[51] Int. Cl.[4] ..... H05H 9/00; H05H 5/02

[52] U.S. Cl. ..... 328/233; 313/360.1

[58] Field of Search ..... 313/360.1; 328/233

[56] References Cited

U.S. PATENT DOCUMENTS

| | | | |
|---|---|---|---|
| 2,145,727 | 1/1939 | Lloyd, Jr. | 313/360.1 X |
| 2,376,439 | 5/1945 | Machlett et al. | 313/285 X |
| 2,521,426 | 9/1950 | Trump et al. | 313/360.1 |
| 3,355,614 | 11/1967 | Geiger et al. | 313/360.1 |
| 3,793,550 | 2/1974 | Thompson, Jr. | 313/360.1 |

*Primary Examiner*—Palmer C. DeMeo

*Attorney, Agent, or Firm*—Herman H. Bains

[57] ABSTRACT

An electrostatic linear accelerator includes an electrode stack comprised of primary electrodes formed or Kovar and supported by annular glass insulators having the same thermal expansion rate as the electrodes. Each glass insulator is provided with a pair of fused-in Kovar ring inserts which are bonded to the electrodes. Each electrode is designed to define a concavo-convex particle trap so that secondary charged particles generated within the accelerated beam area cannot reach the inner surface of an insulator. Each insulator has a generated inner surface profile which is so configured that the electrical field at this surface contains no significant tangential component. A spark gap trigger assembly is provided, which energizes spark gaps protecting the electrodes affected by over voltage to prevent excessive energy dissipation in the electrode stack.

7 Claims, 2 Drawing Sheets

LINEAR PARTICLE ACCELERATOR WITH SEAL STRUCTURE BETWEEN ELECTRODES AND INSULATORS

This invention relates to linear accelerators and, more particularly, to an improved construction of linear accelerators.

BACKGROUND OF THE INVENTION

In the design of particle accelerators, especially electrostatic linear accelerators, the particular configuration and construction of the electrodes and supporting insulators is of critical importance. In conventional single and tandem Van de Graaff accelerators, the electrodes may be of planar configuration, or they may have the well-known top hat construction. The electrodes in these prior art accelerators are formed of a conductive metal, such as aluminum, stainless steel, titanium, or various alloys of these metals. The support insulators for the electrodes are typically formed of glass or of ceramic material and are bonded to the adjacent pair of electrodes to form a vacuum seal therebetween.

However, inasmuch as ceramic insulators are opaque, one cannot easily visually inspect these ceramic insulators for damage. In other particle accelerators, the electrodes are bonded to glass support insulators by soft materials, such as organic bonding agents, which may volatilize during operation of the accelerator. This volatilized organic material may be deposited on the tube electrodes, thereby requiring a time-consuming cleaning or conditioning operation.

Another problem associated with conventional prior art electrostatic linear accelerators is spallation of an insulator surface during flashover produced when it is impacted by high velocity particles. Further, insulators formed of ceramic sometimes have pipes or internal cracks therein which do not extend through or communicate with the vacuum side of the tube. However, if sufficient spalling occurs, the pipe may intercommunicate the pressure side of an accelerator tube with the vacuum side, which could result in the catastrophic loss of the expensive gas used in the pressure chamber and severe damage to the vacuum system.

In the configuration of the top hat electrodes, particle traps are defined between adjacent electrodes and are intended to prevent high velocity particles from striking the vacuum side surface of the support insulators. Although the top hat electrodes function reasonably well in preventing high velocity particles from impacting the surfaces of the insulators, the vacuum side surfaces of the insulators are not located in an "out of sight" location with respect to substantially all orbits of high velocity scattered particles. Therefore, spalling can occur in tube electrodes having the top hat electrode configuration, as well as planar electrodes.

SUMMARY OF THE INVENTION

An object of this invention is to provide an improved electrostatic linear accelerator in which the electrodes are formed of Kovar, which are bonded to glass insulators having fused-in Kovar inserts formed of the alloy as the electrodes. Kovar is the trademark used with an iron-based alloy, including nickel, cobalt, and manganese. The electrodes, insulators and inserts have matched thermal expansion rates permitting the inserts to be fused into the glass insulators and the formation of bonds which are not affected by temperature. The transparent glass insulators also permit easy visual inspection of the insulators to determine the presence of damage.

Another object of this invention is the provision in a linear accelerator of an electrode design having a configuration defining a particle trap, which prevents high velocity particles from impacting the vacuum side of the insulators. Each electrode has an annular concavo-convex portion which is dimensioned so that the vacuum surface of each insulator is located "out of sight" of substantially all orbits of secondary high velocity particles.

A further object of this invention is to provide a linear accelerator with a novel insulator design which not only permits effective hard bonding of the metal electrodes to the glass insulators, but further permits construction of the insulator having a preselected safety factor with respect to the dielectic stress produced by the electric field strength within the insulator. Each insulator has a generated curved surface on its vacuum side whose curvature is such that there is no normal component of the electrical field at substantially any place along the generated surface. This configuration inhibits the process of surface electron multiplication due to the return of secondary electrons which would be released, should a swift particle strike the insulator surface.

These and other objects of the invention will be more fully defined in the following Specification.

FIGURES OF THE DRAWING

DESCRIPTION OF THE PREFERRED EMBODIMENT

Figure 1:
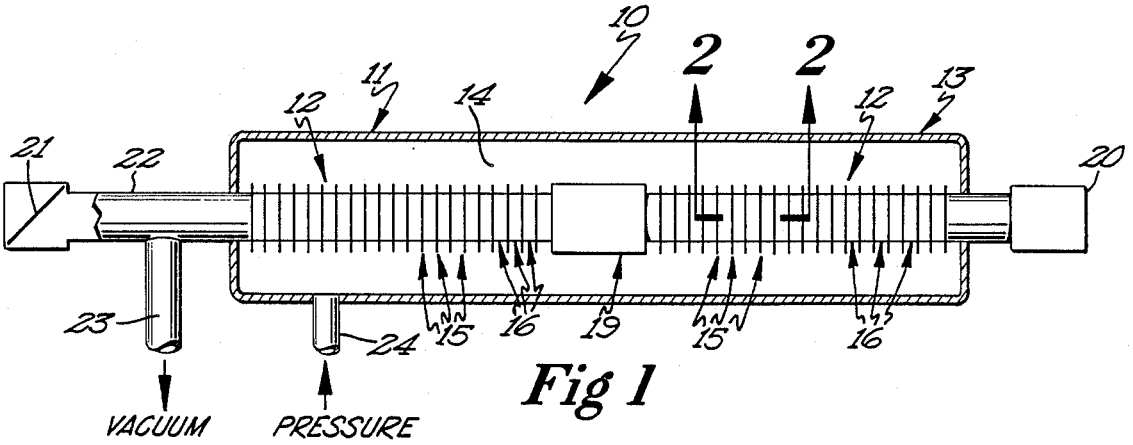
FIG. 1 is a diagrammatic side sectional view of a linear accelerator.

Referring now to the drawings and, more specifically, to FIG. 1, it will be seen that one embodiment of a particle accelerator, designated generally by the reference numeral 10, is thereshown. The particle accelerator 10 is diagrammatically illustrated and comprises a tandem Van de Graaff electrostatic linear accelerator. The linear particle accelerator 10 comprises an accelerator tube 11, which includes a pair of tandemly arranged electrode stacks 12 positioned within a pressure jacket 13. The interior of the pressure jacket 13 defines a pressure chamber 14, which is adapted to contain the conventional pressure gas, such as sulfur hexafluoride.

Figure 2:
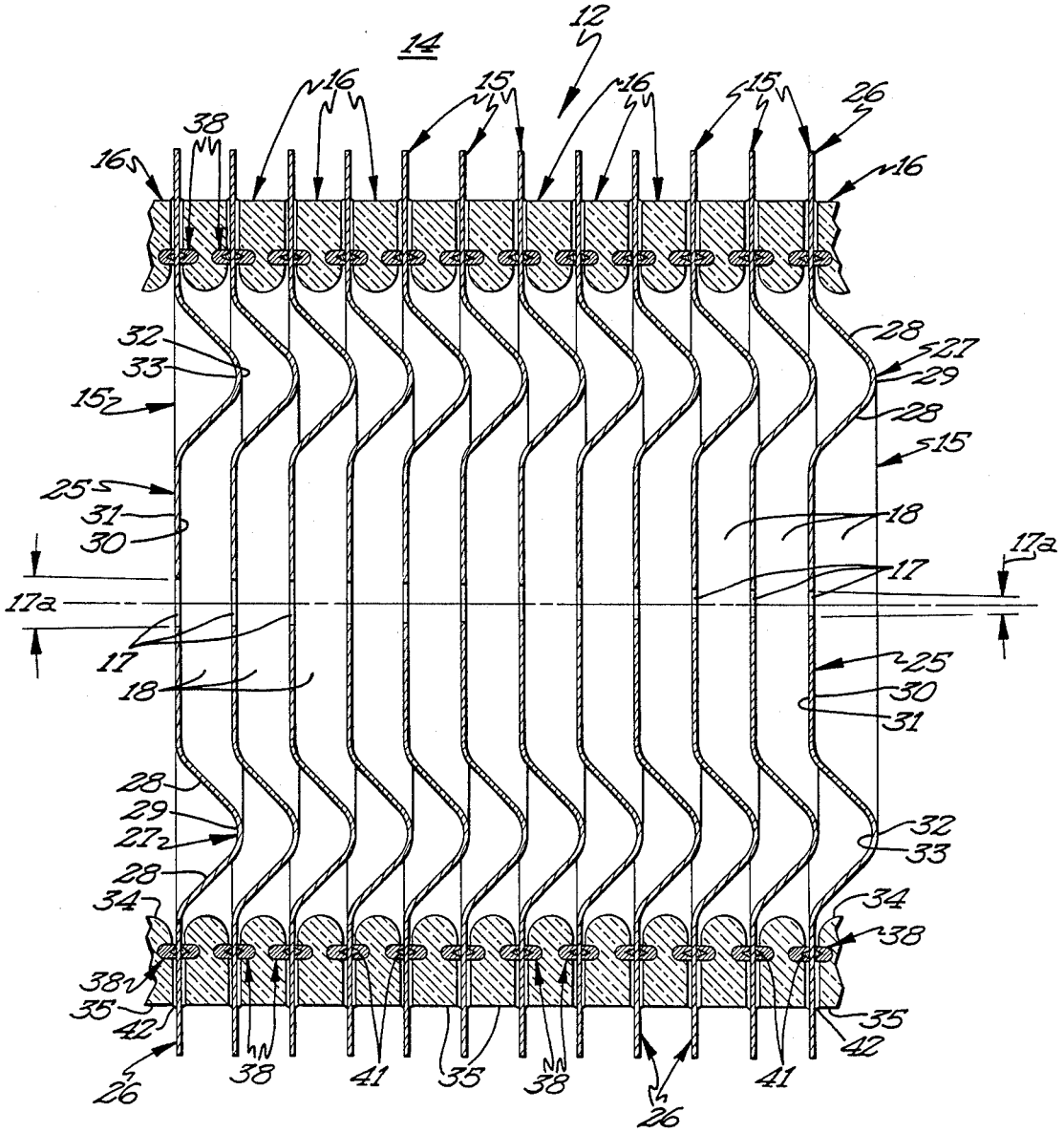
FIG. 2 is a cross-sectional view taken approximately along the line 2—2 of FIG. 1 and looking in the direction of the arrows.

Referring now to FIG. 2, it will be seen that each electrode stack 23 is comprised of a plurality of circular electrodes arranged in side-by-side or metallically spaced apart relationship and is secured to and supported by annular spacer insulators 16. In this regard, each electrode 15 is bonded to the adjacent insulator in sealing relation thereto so that the volumetric space located interiorly of the insulators defines the vacuum chamber 18 for the accelerator tube. It will also be noted that each electrode has a centrally located opening 17 therein and these openings are disposed in coaxial relation with respect to each other. It will also be noted that the openings 17 in the electrodes progressively increase in size from the first electrode in a downstream direction.

Referring again to FIG. 1, it will be seen that a charge stripper 19 of conventional construction is positioned between the tandemly arranged electrode stacks 12 and serves to change the electric charge of the particles of the beam as the particle beam is accelerated through the first electrode stack into the second electrode stack. The charged stripper may be comprised of a stripping foil or a stripping gas which changes the electric charge of the beam particles from positive to negative.

The particle accelerator 10 also includes a conventional source 20 of charged particles that are generated and emitted as a beam through the centrally located openings in the first electrode stack and then through the charged stripper and thereafter through the openings in the second electrode stack. The particle source may produce a beam of ions, protons, or electrons, depending on the specific purpose of the accelerator operation. The particle source may be an ion pump or similar particle beam generator.

Downstream of the second electrode stack is a target 21 against which the accelerated charged particles are directed. Although not shown in the drawing, a magnetic focusing device will be provided for focusing the particle beam at the target. The particular target used will be determined by the kind of result or experiment one is undertaking.

If, for example, the particle beam is intended to generate energy for the production of x-rays used in the irradiation of sealed packaged food products, such as vegetables, one will use one kind of target. On the other hand, if the particle beam is intended to impact an atomic nucleus, another kind of target will be selected. The beam source and the target, while constituting essential features of particle accelerators, are not, per se, part of the present invention.

It will be seen that the target 21 is contained within a tube or conduit 22, which is connected in communicating relation with the downstream electrode stack 12 and projects longitudinally from the accelerator tube 11. A conduit 23 is connected in communicating relation to the tube 22 and is also connected to a vacuum pump for drawing a vacuum in the electrode stacks. It will also be noted that a conduit 24 is connected in communicating relation with the pressure chamber 14 for supplying the pressure gas sulfur hexafluoride to the pressure chamber.

Figures 3, 4, 5:
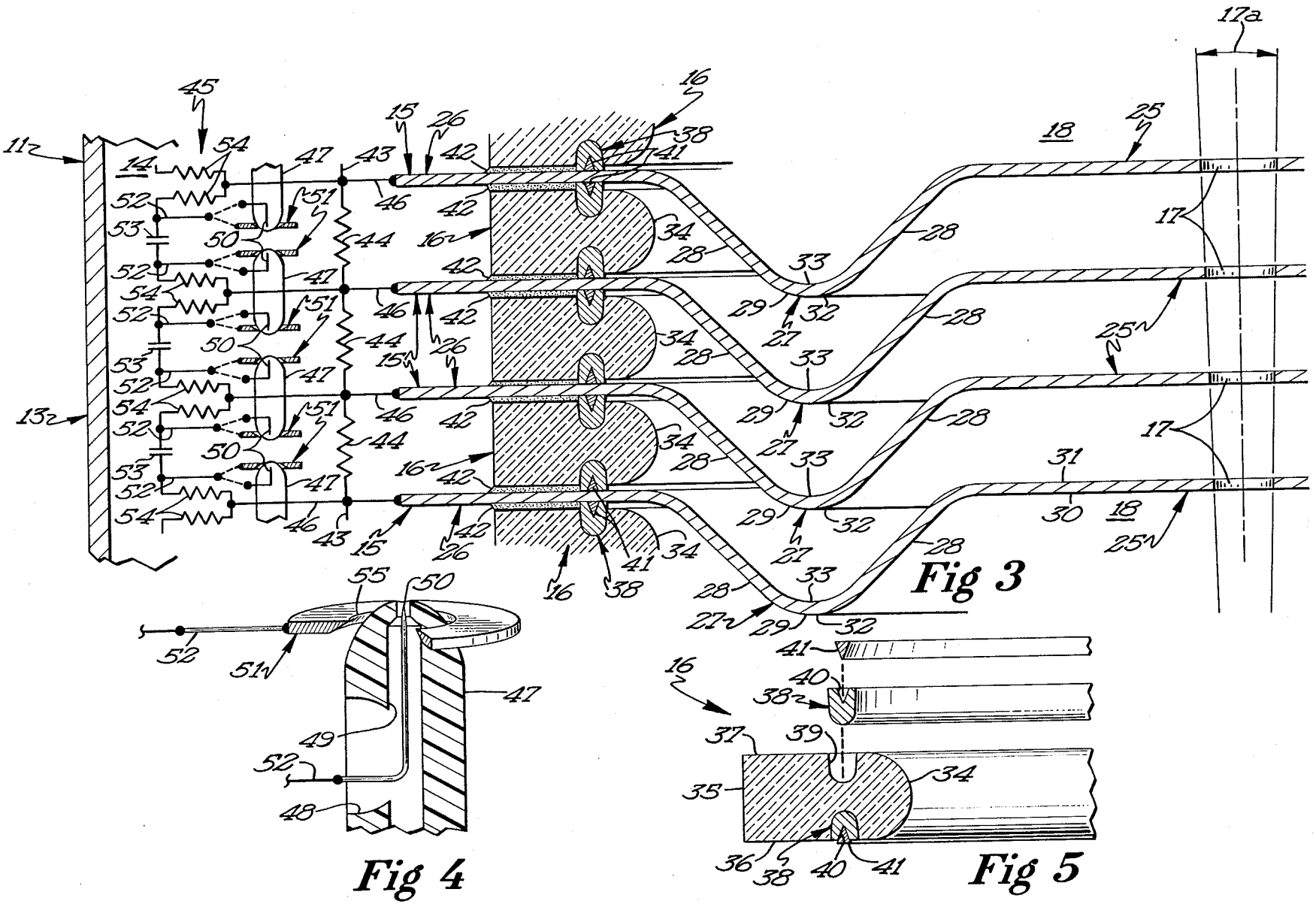
FIG. 3 is a fragmentary sectional view on an enlarged scale of a portion of the electrode stack, showing details of construction of various components thereof.
FIG. 4 is a fragmentary enlarged view of components of the spark gap circuit, certain parts thereof broken away and other parts thereof illustrated in section for clarity.
FIG. 5 is a fragmentary exploded view of a portion of an insulator.

Referring now to FIGS. 2 and 3, it will be seen that each Kovar electrode 15 is comprised of a substantially flat central portion 25, a substantially flat circumferential portion 26, and an annular concavo-convex portion 27 disposed between the central and marginal portions. It is also pointed out that the typical composition of Kovar is approximately 29% nickel, 17% cobalt, 0.3% manganese, and approximately 53.7% iron. The annular concavo-convex portion includes annular legs 28, which are interconnected by a web or bight portion 29. The legs 28 extend at an angle of approximately 45 degrees from the general plane of each electrode.

Each electrode also includes an upstream surface 30 and a downstream surface 31. The upstream surfaces of the central and circumferential portions of each electrode are disposed in co-planar relation. Similarly, the downstream surfaces of the central and circumferential portions of each electrode are disposed in co-planar relation. It will be noted that the upstream annular convex surface portion 32 of each electrode projects beyond the downstream central and circumferential surfaces of the next adjacent upstream electrode. The annular convex surface 32 of each electrode cooperates with concave surface 33 of the next adjacent upstream electrode to define an annular particle trap. It is also pointed out that the maximum surface electrical field strength is located in the annular concave surface portion of each electrode.

Each electrode 13 is bonded to a pair of annular glass insulators 16 at its circumferential portion, as best seen in FIG. 3. The glass insulators are formed of Corning 7052 or a commercial equivalent glass, and this glass has the same expansion characteristics as the electrodes. Therefore, temperature changes of the glass insulators and electrodes does not affect the seals formed therebetween.

Each insulator includes an inner annular curved surface 34, a substantially flat outer surface 35, a substantially flat upstream surface 36, and a substantially flat downstream surface 37. The curved surface 34 is a generated surface and its curvature imparts an advantage to be described hereinbelow. This inner surface 34 of each insulator is located "out of direct line of sight" with respect to the location of the maximum surface field strength in the concave surface or depression of the adjacent electrode. Thus, the particle trap configuration of the electrodes prevents both swift ions and material evaporated by flashover from bombarding the inner surface of each insulator. These ions release secondary electrons from the insulator surface, producing patches of charge on the insulator, and, thus, seriously disturbing the local electric field on the insulator surface.

Each insulator has a pair of annular Kovar inserts 38 fused into recesses 39 in the upstream and downstream surfaces thereof, as best seen in FIG. 3. It will be noted that each Kovar insert 38 has a small recess 40 therein, which accommodates an annular silver-tin solder element 41 therein. The silver-tin solder element is fused to the insert and to the associated electrode surface to form a vacuum seal thereat.

It will be noted that the insulators extend outboard of the Kovar inserts 38 so that the inserts are disposed closer to the generated curved surface 34 than the flat outer pressure surface 35. The purpose of increasing this dimension is two-fold, (1) to maintain mechanical strength, should an internal spark between the Kovar shatter the vacuum side of the insulator, and (2) the provision of a pair of recesses between each electrode and the adjacent insulators outboard of the Kovar insert 38, which are filled with polyvinyl acetate adhesive 42 in order to reduce the risk of catastrophic leak between the pressure and vacuum sides of the insulator.

The generated surface 34 of each insulator is determined by the spacing between the inner ends of the Kovar inserts 38. The smaller the spacing, the more perfectly the electric field appears to radiate from a single point within the insulator, which would decrease the surface tangential electrical field by a Pi/2 relative to a straight insulator. However, as the gap between the inserts is decreased, the electric field strength within the glass increases. The configuration of the generated surface and the spacing between the Kovar inserts was, therefore, based on a dielectric stress of 400 volts per mill. (0.001 inches) at a field strength in the vacuum gap of 80 KV/inch. The vacuum gap is the spacing between adjacent electrodes. This insures a safety factor of between 1.5 and 2, assuming published values of dielectric strengths. This factor is needed as transient over-voltages occur during spark-over of the accelerator.

The electrode surfaces, i.e., the flat circumferential portion 26, at the insulator diameter are orthogonal to the tube direction; but, due to the proximity of the first bend or leg of the concavo-convex portion, the electrical field distribution is not symmetrical about an axis half-way between adjacent electrodes. It was desired to utilize the criterion that at all places on the insulator surface there would be no normal component of the electrical field. This establishment of this field condition inhibits the process of surface electron multiplication due to the return of secondary electrons which would be released, should a swift particle strike the insulator surface. The generated surface 34 of each insulator has a curvature or profile such as to make the electrical field orthogonal to the surface.

A protective spark gap assembly is provided which will conduct during spark over, even though there is a discharge occurring in the vacuum side of the gap. In this regard, the accelerator is subjected to surges or over-voltages which can produce spark over in the vacuum gap; that is, between the pair of adjacent electrodes affected. Referring specifically to FIG. 3, it will be seen that the electrodes 15 are connected to a source of electrical power by a main bus line or conductor 43. Potential grading resistors 44 of 100 Mohm or similar resistance are interposed in the main conductor 43 and are electrically connected across adjacent electrodes. The grading resistors control the variation in the voltage difference across two adjacent tube electrodes.

The spark gap assembly includes a plurality of trigger electrode mechanisms 45, and each is electrically connected to the main supply conductor 43 and to a tube electrode 15 by a conductor 46. Each trigger electrode mechanism 45 includes a conducting button 47 which may be formed of any suitable metallic material, such as stainless steel or the like. Each button has a pair of recesses 48 therein, and each recess communicates with one of a pair of elongate bores in the associated button. Each bore accommodates an elongate needle type trigger electrode 50, whose outer end is located slightly below the associated convex end surface of the conducting button. Alternatively, an external annular trigger electrode 51 can be substituted for each needle type trigger electrode, and each is positioned around, but slightly below, one convex end surface of a button. It is pointed out that only one type of trigger electrode will be used with a conducting button. Each annular trigger electrode has a sharp beveled edge disposed in spaced, but close, proximal relation with respect to the hemispherical end of the button. A trigger spark gap is defined between each annular electrode 51 and its associated button 47 or between the needle electrode 50 and the button 47.

The buttons 47 and their respective associated trigger electrode types 50 or 51 define a spark gap with respect to the button 47 and either trigger electrode 50 or 51 of the adjacent assembly. A plurality of 50 pF capacitors 53 are provided and each is connected across a pair of trigger electrode mechanisms. Each adjacent pair of capacitors 53 are electrically connected by a pair of 100 Mohm or similar value resistors to the conductor 46. A conductor 52 electrically connects either trigger electrode 50 or 51 to the associated capacitor circuit.

When local over-voltage occurs, spark over can occur in the vacuum gap between adjacent tube electrodes, and this spark over can be propagated in conventional accelerators, the stored electrical energy being then partially dissipated in the vacuum gap. However, the protective trigger electrode mechanisms will conduct during spark over, even though there is a discharge occurring in the vacuum side of the gap. To this end, a small amount of energy is stored in each of the capacitors 53 and each capacitor is local to the spark gap between adjacent trigger electrodes and is local with respect to a pair of tube electrodes. Therefore, when there is a rapid voltage change across a resistor 44 due to a vacuum side discharge between the two electrodes 15, the affected capacitor will discharge, and this energy, when released as a spark between the trigger and main discharge electrode, generates ions and electrons which, on being attracted into the main gap, causes the main discharge to occur between adjacent button 47. However, it is pointed out that, under static conditions, no potential difference exists between the main and trigger electrodes, which implies that the potential difference between the plates of the trigger capacitor is the same as the electrodes in the electrode stack.

Referring again to FIG. 2, it will be noted that the openings 17 in the electrodes of each stack increase in size in electrode stack from the source end towards the target end. The openings collectively define a cone of included angle 3 degrees and this serves to prevent positive ions hitting downstream electrodes while trapping electrons on each successive electrode. It is also pointed out that the electrode stacks in operation are preferably vertically disposed, with the target located at the end of the stack with the largest opening 17.

From the foregoing, it will be seen that I have provided a particle accelerator which effectively utilizes Kovar electrodes metallically bonded to glass insulators. Since the electrodes and insulators have matched thermal expansion rates, the seals between them are not affected by temperature variations.

It will also be seen that the electrodes are designed and fabricated to define particle traps, which prevent secondary charged particles generated within the accelerated beam area from reaching the inner electrode-insulator surface. It will further be noted that the glass insulators are provided with two fused-in Kovar attachment rings and are also provided with an inner or vacuum side surface profile such that the electrical field at this surface contains no significant tangential component.

It will also be noted from the above description that I have provided the particle accelerator with a triggered spark gap assembly which functions to protect the accelerating gap between adjacent electrodes from excessive energy dissipation during electrical breakdown. Finally, it has been found that this improved particle accelerator, including the novel electrode design, insulator design, and the provision of spark gaps, permits the accelerator to operate at a substantially larger longitudinal field strength than the present practice without noticeable deterioration from repeated sparking.

Thus, it will be noted that I have provided a novel and improved particle accelerator which functions in a manner decidedly improved over conventional particle accelerators.

What is claimed is:

1. A linear accelerator including a vacuum chamber, a pressure chamber exteriorly of the vacuum chamber, source means for producing a directed beam of charged particles inside the vacuum chamber, a target against which the beam of charged particles is directed, a plurality of similar circular electrodes disposed in substantially uniformly spaced apart, side-by-side relation, each electrode being formed of an alloy comprised of iron, nickel, and cobalt, and each electrode having a substantially flat central portion, a substantially flat circumferential portion, and an axially offset portion located intermediate the central and circumferential portions, each electrode having a centrally located opening in the central portion thereof, the major portion of each electrode being disposed within the vacuum chamber, and the spacing between adjacent electrodes defining a vacuum gap, means electrically connecting the electrodes to a source of electrical power, a plurality of similar annular support insulators, each being formed of a glass material having the same thermal expansion rate as the electrodes, each insulator having opposed front and rear surfaces and having an inner surface, each front and rear surface of each insulator having an annular groove therein, said grooves in each insulator being disposed in annular alignment, and a plurality of annular metallic inserts, each being positioned and fused within the recess of an insulator, and each being formed of the same alloy as the electrodes, means metallically bonding the annular inserts of each insulator to the circumferential portions of a pair of adjacent electrodes to form a seal thereat.

2. The linear accelerator as defined in claim 1 wherein the spacing between the metallic inserts of each insulator defines the region of greatest dielectric stress in the insulator when the electrodes are energized, said spacing being of a magnitude to provide a safety factor of between 1.5 and 2 when the electrical field strength is approximately 80 KV/inch.

3. The linear accelerator as defined in claim 1 wherein the inner surface of each insulator defines a developed curved surface whose curvature is disposed substantially normal to all electrical field lines generated by the electrical field between the metallic inserts of the insulator.

4. The linear accelerator as defined in claim 1 wherein the opening in each electrode is larger than the next adjacent upstream electrode.

5. The linear accelerator as defined in claim 1 wherein the axial offset portion of each electrode is of annular concavo-convex configuration, each electrode having upstream and downstream surfaces, the convex surface of the annular concavo-convex portion of each electrode being disposed upstream.

6. The linear accelerator as defined in claim 5 wherein the convex upstream surface of the axially offset annular concavo-convex portion of each electrode extends beyond the plane of the downstream surface of the central and marginal portions of the next adjacent electrode.

7. An electrostatic linear accelerator including a vacuum chamber, a pressure chamber exteriorly of the vacuum chamber, source means for producing a directed beam of charged particles inside the vacuum chamber, a target against which the beam of charged particles is directed, a plurality of similar circular primary electrodes disposed in substantially uniform spaced apart side-by-side relation, each electrode having a substantially flat central portion, a substantially flat circumferential portion, and an axially offset portion located intermediate the central and circumferential portions, each electrode having a centrally located opening in the central portion thereof, the major portion of each electrode being disposed within the vacuum chamber, and the spacing between the electrodes defining a vacuum gap, a plurality of similar annular support insulators, each being positioned between and bonded to the circumferential portions of a pair of adjacent electrodes to form a seal thereat, said electrodes being electrically connected to each other in series and to a source of electrical power, voltage sensing means connected across each adjacent pair of primary electrodes, a spark gap assembly connected to said source of electrical power and including a plurality of trigger electrode mechanisms being electrically connected in series, each trigger electrode mechanism being electrically connected to a primary electrode and each including a trigger electrode circuit and two pairs of trigger electrodes, the trigger electrodes of each pair being disposed in spaced apart proximal relation to each other and defining a spark gap therebetween, and a plurality of capacitors of predetermined capacitance, each being electrically connected across a pair of trigger electrode mechanisms, each capacitor being operable to release electrical energy as a spark across spark gap between the trigger electrodes of the associated trigger electrode mechanism and the associated primary electrode in response to a voltage drop across a voltage sensing means between a pair of adjacent primary electrodes to thereby prevent excessive energy dissipation during electrical breakdown.

* * * * *